US005450949A

United States Patent [19]

Cocchi et al.

[11] Patent Number: 5,450,949

[45] Date of Patent: Sep. 19, 1995

[54] REEL OF MATERIAL IN TAPE FORM

[75] Inventors: Lorenzo Cocchi; Antonio Gamberini, both of Bologna, Italy

[73] Assignee: G.D. Societa per Azioni, Bologna, Italy

[21] Appl. No.: 28,254

[22] Filed: Mar. 9, 1993

[30] Foreign Application Priority Data

Mar. 13, 1992 [IT] Italy ..... B092A0087

[51] Int. Cl.[6] ..... B65D 69/00

[52] U.S. Cl. ..... 206/225; 206/389; 206/410; 242/164

[58] Field of Search ..... 206/225, 389, 390, 398, 206/410; 242/164

[56] References Cited

U.S. PATENT DOCUMENTS

| | | | |
|---|---|---|---|
| 866,855 | 9/1907 | Gay | 242/164 |
| 1,465,786 | 8/1923 | Wheildon | 206/389 |
| 1,560,555 | 11/1925 | Flynn | 206/389 |
| 1,929,599 | 10/1933 | Millholland | 206/210 |
| 2,034,471 | 3/1936 | Joyce | 206/410 |
| 2,094,454 | 9/1937 | Keville | 206/389 |
| 2,105,367 | 1/1938 | Parsons | 206/410 |

FOREIGN PATENT DOCUMENTS

| | | | |
|---|---|---|---|
| 876137 | 8/1961 | United Kingdom | 206/410 |

*Primary Examiner*—David T. Fidei
*Attorney, Agent, or Firm*—Ladas & Parry

[57] ABSTRACT

A reel (1) of material in tape form (2) wound on a core (3) to form a plurality of turns and provided with an outer end (4) retained on the reel (1) by a retainer, such as a gummed band. The outer end (4) of the material in tape form (2) is weighted relative to the rest of the tape (2), for example by attaching a label (7) to the outer end (4), so that on removing or cutting the retainer (5) the outer end (4) automatically separates from the reel (1) by gravity.

3 Claims, 1 Drawing Sheet

REEL OF MATERIAL IN TAPE FORM

BACKGROUND OF THE INVENTION

1. Field of the Invention

This invention relates to a reel of material in tape form.

2. Brief Description of the Prior Art

In automatic machines which use material in tape form, the tape to be fed to the machines is withdrawn from respective reels which when empty are automatically replaced by devices which grip the outer end of the new reel and join it to the inner end of an emptying reel.

In a new reel the outer end of the tape is generally kept fixed by a fixing element such as a gummed band or a piece of adhesive tape, which is applied partly to the outer end of the new tape and partly to the reel.

When changing the reel the outer end of the tape has to be released from the new reel, this being achieved by manually removing the fixing element or by automatically or manually cutting it at the outer end of the tape.

The outer end of the tape is then withdrawn from the new reel and is joined to the inner end of the tape from the empty reel by a connection element, or by welding if the tape is of thermoweldable material.

It often happens that the outer end of the new tape is joined to the inner end of the used tape in a station different from and following that in which the fixing element is removed.

The result of this is that in moving the reel between one station and the next the free end of the new tape frequently tends to again adhere to the reel. The reasons for this are numerous, for example the free end may tend to adhere to the reel because of the type of material with which the tape is formed, or because of the generation of magnetostatic phenomena.

The main reason causing and/or aggravating the problem is however the small tape thickness, which also makes it very difficult to separate the free end from the relative reel.

In this respect, the free end is withdrawn from the reel by using, for example, wedge-shaped members which because of the small thickness of the tape on which they have to operate are necessarily thin with sharp edges. The problem is aggravated by the fact that the wedge-shaped members have necessarily to be kept in contact with the reel, with the inevitable risk of cutting the tape.

SUMMARY OF THE INVENTION

The object of the present invention is to allow easy separation of the outer end of the tape from the relative reel without any possibility of damaging the reel.

This is attained according to the present invention by a reel of material in tape form wound on a core to form a plurality of turns and provided with an outer end retained on the reel by respective retention means, characterised in that said outer end of the material in tape form is weighted relative to the rest of the tape so that on releasing said retention means said outer end automatically separates from the reel by gravity.

BRIEF DESCRIPTION OF THE DRAWING

The invention is described in detail hereinafter with reference to the accompanying drawing, which shows one embodiment thereof by way of non-limiting example, and in which.

DETAILED DESCRIPTION OF THE PREFERRED EMBODIMENT

Figure 1:
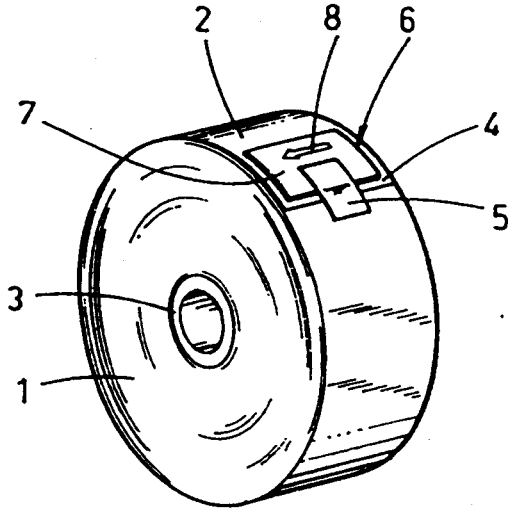
FIG. 1 is a perspective view, not to scale, of a reel of material in tape form in accordance with the present invention, shown in its transfer configuration.

With reference to the accompanying figures, the reel according to the present invention is indicated overall by 1 and consists of a material in tape form 2 wound on a core 3 to form a plurality of turns. The tape 2 has an outer end 4 which is retained on the reel 1 by respective retention means 5, such as a gummed band or a piece of adhesive tape, to enable it to be transferred from the production machine to a user machine without the tape 2 unwinding. With particular reference to FIG. 1, the outer end 4 is made heavier than the rest of the tape 2 so that on removing or cutting the retention band 5, the outer end 4 separates automatically from the reel 1 by gravity.

Figure 2:
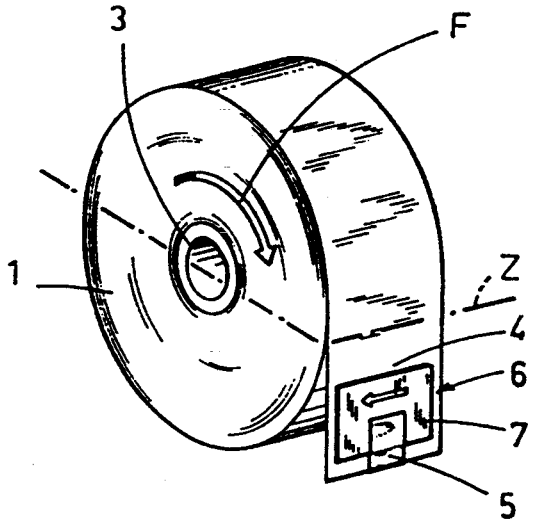
FIG. 2 is a perspective view, not to scale, of the reel of FIG. 1 shown partly unwound.

The means for weighting the outer end 4 are numerous and equivalent; for example it can be provided with weighting means 6. In FIGS. 1 and 2 the weighting means 6 consist of a label 7. The dimensions and material of the label 7 depend obviously on the constituent material of the tape 2, in that the greater the unit weight of the tape the greater has to be the weight of the label 7.

The label 7 can be attached to the tape 2 before the retention band 5 so as to be interposed between the tape 2 and this latter, as shown in FIG. 1.

As shown in FIGS. 1 and 2, label 7 can also be used as a support for advertisements, information materials or instructions, both printed and in the form of images (8) for example indicating the type of material forming the tape 2 and other of its characteristics. In FIGS. 1 and 2 the image 8 is shown as an arrow indicating the correct positioning of the reel 1 relative to unwinding means, not shown.

Figure 3:
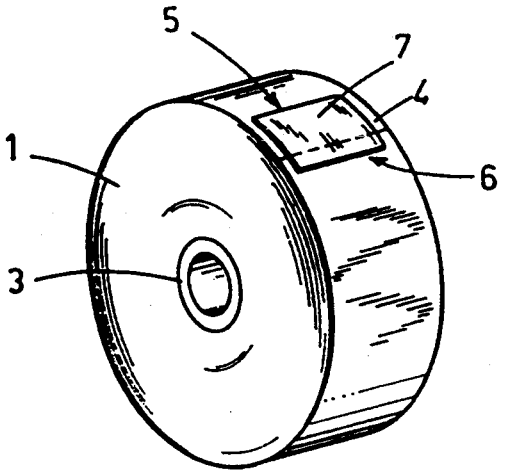
FIG. 3 is a perspective view of a modification to the reel of FIG. 1.

It is however of fundamental importance that the weight of the label 7 be such as to cause the outer end 4 to automatically separate from the reel 1 as shown in FIG. 2. In FIG. 2 the retention band 5 has already been cut and the reel 1 put under rotation about its axis in the direction indicated by the arrow F, ie in its unwinding direction. As soon as the outer end 4 reaches below the level of the centre of the reel 1 (indicated by z in FIG. 2), the weight of the label 7 overcomes the force of adhesion of the outer end 4 to the reel 1 and obliges the outer end 4 to descend along a substantially vertical trajectory. In the modification shown in FIG. 3, the weighting means 6 and the retention band 5 are one and the same, ie only one band or label 7 of the required weight is provided, which retains the outer end 4 on the reel 1 and, when cut to release the outer end 4, acts as the weighting means 6 for separating the outer end 4 from the reel 1 exactly as shown in FIG. 2. In FIG. 3 that part of the retention band 5 applied to the outer end 4 is bigger than that part of the retention band 5 applied to the reel 1, so enabling the weight of the outer end 4 to be increased by simply varying the arrangement of the retention band 5.

One of the advantages of the present invention is its reliability, combined with the fact that label 7 can be used as an advertising or information carrier.

I claim:

1. A roll of material in tape form forming a plurality of layers, the outer layer having an outer end which is weighted relative to the rest of the roll of material, said roll of material comprising:

weighting means attached to the outer surface of said outer end; and retention means for retaining said weighted outer end against the layer of material next inwardly of said weighted outer end, said retention means joining the outer surface of said weighted outer end and the outer surface of said next inwardly layer, the weight of said weighted end being such that, upon releasing said retention means, said outer end separates from said roll of material by gravity.

2. The roll of material as claimed in claim 1, wherein said weighting means comprises a band or label attached to said outer end.

3. The roll of material as claimed in claim 1, wherein said weighting means comprises a band or label attached to said outer end and forms a support element for an image or writing.

* * * * *